US007168926B2

(12) United States Patent
Manda et al.

(10) Patent No.: US 7,168,926 B2
(45) Date of Patent: Jan. 30, 2007

(54) AXIAL FLOW PUMP AND FLUID CIRCULATING APPARATUS

(75) Inventors: Takahiko Manda, Mishima (JP); Yoshifumi Tanabe, Yokka (JP); Kazunori Murakami, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 624 days.

(21) Appl. No.: 10/661,710

(22) Filed: Sep. 12, 2003

(65) Prior Publication Data

US 2005/0100451 A1 May 12, 2005

(30) Foreign Application Priority Data

Dec. 2, 2002 (JP) ..... 2002-349824

(51) Int. Cl.
*F04B 17/03* (2006.01)

(52) U.S. Cl. ..... 417/356; 417/366

(58) Field of Classification Search ..... 417/355, 417/356, 366, 369, 371
See application file for complete search history.

(56) References Cited

U.S. PATENT DOCUMENTS 3,704,078 A * 11/1972 Conery et al. ..... 417/369
3,719,436 A * 3/1973 McFarlin ..... 417/356
3,972,653 A 8/1976 Travis et al.
4,408,966 A 10/1983 Maruyama
4,808,087 A * 2/1989 Tsutsui et al. ..... 417/369
5,088,899 A * 2/1992 Blecker et al. ..... 417/356
5,527,159 A 6/1996 Bozeman, Jr. et al.
6,109,887 A 8/2000 Takura et al.
6,514,053 B2 * 2/2003 Takura et al. ..... 417/371
6,554,584 B2 4/2003 Takura et al.
6,813,328 B2 * 11/2004 Kitch et al. ..... 417/356
6,884,043 B2 * 4/2005 Kimberlin et al. ..... 417/366

* cited by examiner

*Primary Examiner*—Michael Koczo, Jr.
(74) *Attorney, Agent, or Firm*—Frishauf, Holtz, Goodman & Chick, P.C.

(57) ABSTRACT

An axial flow pump comprising a inner wall disposed in contact with the inside of a stator having winding, a rotor disposed inside the inner wall and adapted to be rotated upon energization of the winding, an axial flow blade formed on an outer periphery of the rotor spirally in a rotational axis direction of the rotor, and a flow path formed between the rotor and the inner wall and defined spirally in the rotational axis direction of the rotor by the axial flow blade. The inner wall is formed of non-magnetic metal and heat generated from the winding upon energization of the winding is transmitted through the inner wall to fluid flowing through the flow path, thereby enhancing the utilization rate of heat generated in the axial flow pump.

5 Claims, 4 Drawing Sheets

AXIAL FLOW PUMP AND FLUID CIRCULATING APPARATUS

CROSS REFERENCE TO RELATED APPLICATION

The present application is based on Japanese Priority Document JP2002-349824 filed on Dec. 2, 2002 the content of which is incorporated herein by reference.

BACKGROUND OF THE INVENTION

1. Field of the Invention

The present invention relates to an axial flow pump provided integrally with a motor, as well as a fluid circulating apparatus provided with the axial flow pump.

2. Discussion of the Background

Heretofore there has been known a fluid circulating apparatus for use in floor heating in which the heat of fluid such as hot water is utilized to heat a floor. In the fluid circulating apparatus, fluid stored in a water tank is heated with a heater and the temperature of the fluid is kept constant, allowing the fluid to circulate along a flow path by means of a pump to warm up the floor.

As the pump used in such a fluid circulating apparatus there is known an axial flow pump integral with a motor wherein a flow path is formed in the interior of the motor comprising a stator and a rotor as principal components, and an axial flow blade is formed on the rotor.

In such an axial flow pump integral with a motor, winding on a stator core of the stator is energized to rotate the rotor, thereby causing the axial flow blade to rotate, and fluid is sucked in from a suction port and is discharged from a discharge port through the motor.

In the axial flow pump integral with a motor, the entire inner periphery surface of the stator and the interior thereof, together with the winding, are molded with an insulating resin to waterproof the stator.

When the motor of the axial flow pump integral with a motor is driven, heat is generated from the winding on the stator core.

If the heat generated from the motor can be transmitted to, for example, the fluid flowing through the interior of the fluid circulating apparatus, it is possible to diminish heating with the heater by an amount corresponding to the amount of heat generated from the motor.

Generally, in the conventional axial flow pump integral with a motor, the stator is waterproofed with resin or the like, as referred to above. The resin or the like is low in thermal conductivity, thus giving rise to the problem that the heat generated from the stator cannot sufficiently be transmitted to the fluid.

Therefore, in the case of the conventional axial flow pump integral with a motor, there is no idea of positively utilizing the heat generated from the winding. Besides, although heat is generated from the motor, the heat cannot be fully utilized in the fluid circulating apparatus.

Further, the thermal conductivity of resin is as low as about 0.2 W (m·k), so if the stator is molded with resin, the heat generated from the winding is hard to escape to the exterior. As a result, it is necessary to provide cooling means, such as cooling fan. Because components of the axial flow pump such as stator winding and stator core are deteriorated by the heat and their service life becomes shorter by the heat generated from the motor.

SUMMARY OF THE INVENTION

Accordingly, it is an object of the present invention to positively utilize heat generated from the motor.

It is another object of the present invention to prolong the service life of an axial flow pump.

The above objects of the present invention are achieved by a novel axial flow pump and a novel fluid circulating apparatus according to the present invention.

The axial flow pump according to the present invention comprises: a case having an outer wall, a fluid suction port and a discharge port, the outer wall having a first thermal conductivity; a stator having winding and disposed in the case; a cylindrical inner wall disposed inside the stator and in contact with the stator, the inner wall having a second thermal conductivity higher than the first thermal conductivity of the outer wall in thermally communication with the stator; a rotor disposed inside the inner wall and rotated upon energization of the winding of the stator, the energization of the winding causing generation of heat from the winding; and a flow path formed between the rotor and the inner wall, the flow path being communicated in fluid with the fluid suction port and the fluid discharge port, wherein the heat from the winding is transferred to the fluid in the flow path through the inner wall due to difference of the thermal conductivity between the outer wall and the inner wall.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
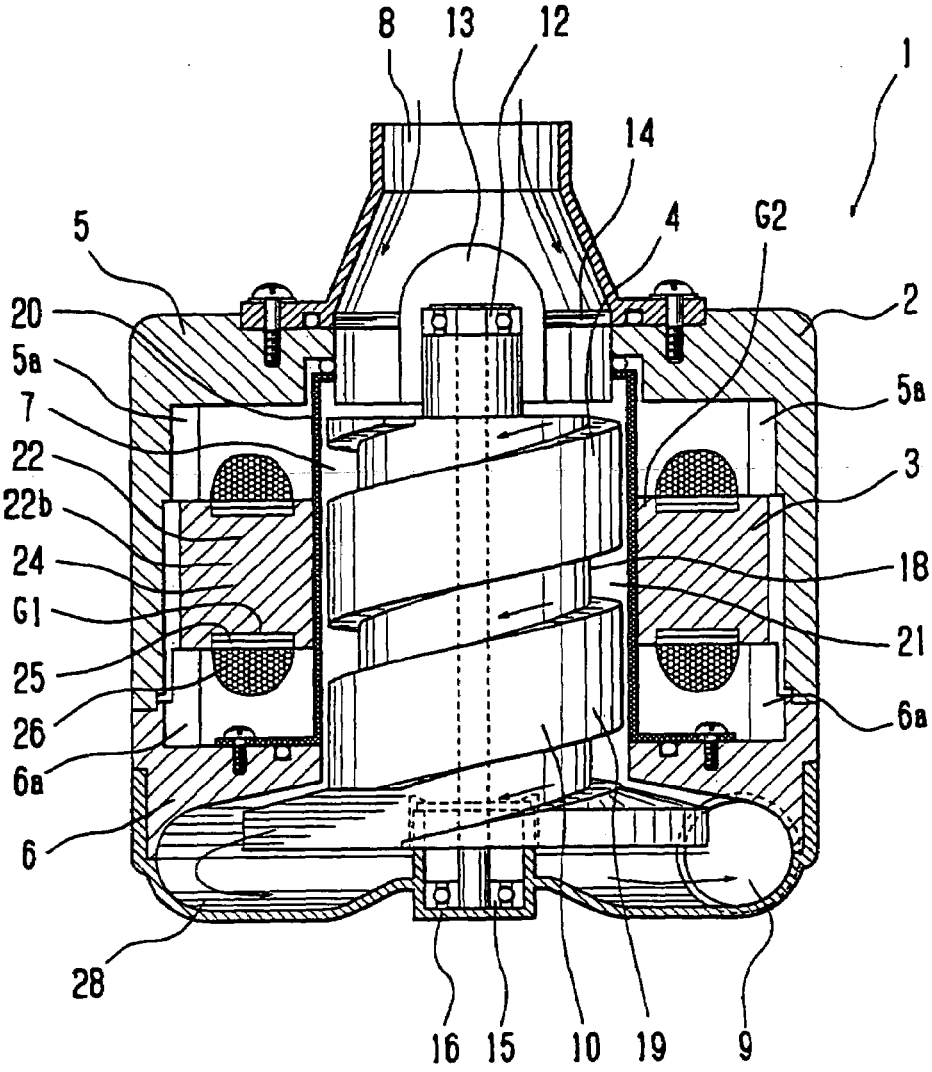
FIG. 1 is a cross-sectional view showing schematically an axial flow pump according to an embodiment of the present invention.
Figure 2:
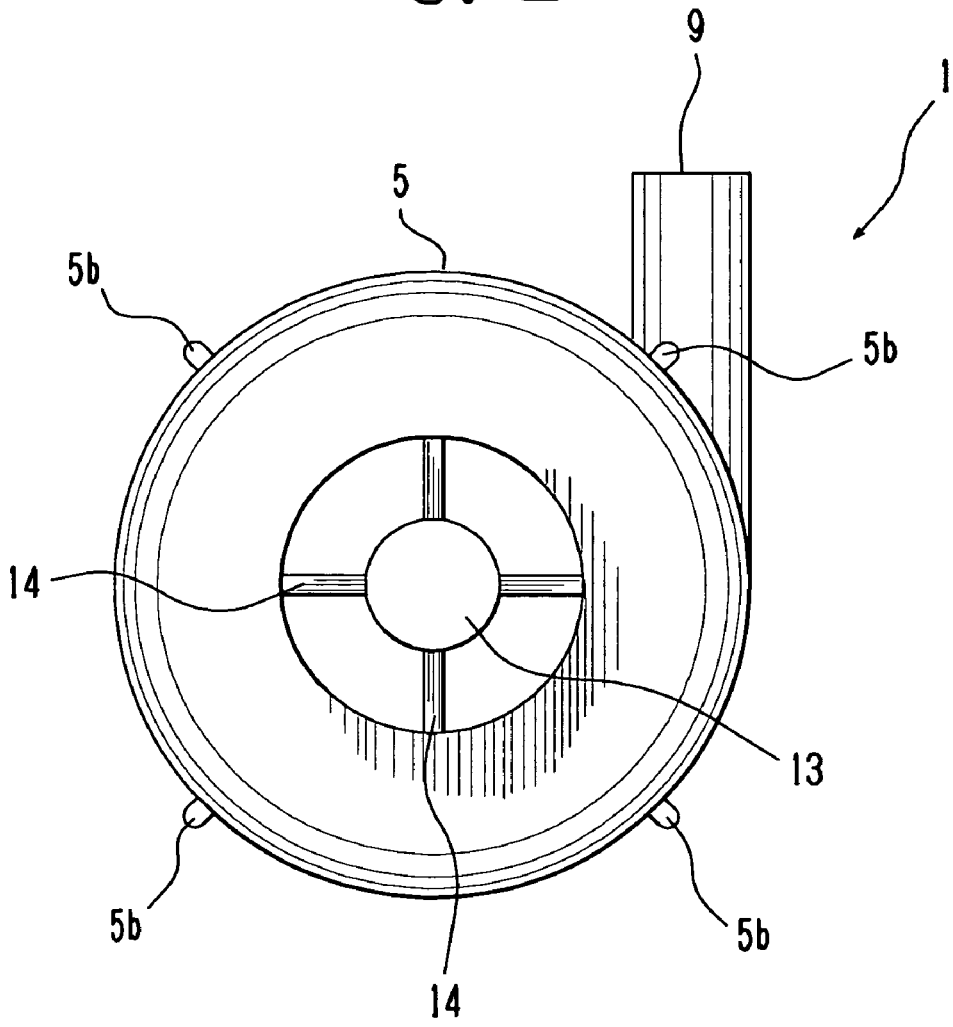
FIG. 2 is a schematic front view thereof.

An axial flow pump according to an embodiment of the present invention will be described with reference to FIGS. 1 to 3. In this embodiment as shown FIG. 1, the axial flow pump 1, is integrally provided with a motor 2 whose rotor 4 functions as an axial flow blade 19. The motor 2 is provided with a stator 3 and the rotor 4 which is disposed inside the stator 3. The stator 3 and the rotor 4 are accommodated within cases 5 and 6.

The case 5 is formed with a suction port 8 for introducing fluid into a pump chamber 7 to be described later, while the case 6 is provided with a discharge port 9 for the discharge of fluid from the pump chamber 7. The cases 5 and 6 used in this embodiment are formed of resin. As the resin which forms the cases 5 and 6 there may be used polypropylene for example.

Reference will now be made to the rotor 4. The rotor 4 is supported by the cases 5 and 6 so as to be rotatable with respect to the cases. The rotor 4 comprises a rotor core 10 and a rotary shaft 11 which holds the rotor core 10. One end side of the rotary shaft 11 is supported through a bearing 12 by a bearing support 13 which is provided in the case 5. The case 5 and the bearing support 13 are bridged by fixed guide blades 14. With the fixed guide blades 14, the suction port 8 is divided into four, as shown in FIG. 2.

An opposite end side of the rotary shaft 11 is supported through a bearing 15 by a bearing support 16 which is provided in the case 6, whereby the rotary shaft 11 is made rotatable with respect to the cases 5 and 6.

The rotor core 10 is formed in a cylindrical shape by molding. The rotor core 10 is provided with four salient poles 17 which are magnetized in such a manner that different poles are alternate in the circumferential direction (see FIG. 3). In an outer periphery of the rotor core 10 is formed an axially continuous recess 18 so as to communicate with both suction port 8 and discharge port 9. The rotor core 10 having such a structure constitutes the axial flow blade 19. A space is defined by the recess 18 of the axial flow blade 19 and an inner periphery surface of a cylindrical inner wall 20 which is made of non-magnetic material such as stainless steel and has higher thermal conductivity than above mentioned case 5, or case 6. And a flow path 21 is formed by the space.

The stator 3 will now be described. The stator 3 is provided with a stator core 22. The stator core 22 is formed by stacking plural silicon steel plates in the axial direction. The stator core 22 comprises a cylindrical portion 22*a* extending in an axial direction coincident with that rotary shaft 11 of the rotor 4 and plural projections 22*b* formed on an inner periphery side of the cylindrical portion 22*a* and each extends toward the center of the cylindrical portion 22. Pitches between the projections 22*b* are set equal to one another. In this embodiment there are formed six projections 22*b*. Adjacent projections 22*b* are arranged at a pitch corresponding to an angle of 60° relative to the axis of the cylindrical portion 22*a*.

Windings 26 are wound respectively on the projections 22*b* of the stator core 22. In the stator 3, magnetic poles 24 are electrically formed by the projections 22*b* and the windings 26. As stated above the stator 3 is provided with six projections 22*b*. Therefore, six magnetic poles 24 are formed by the projections 22*b* and the windings 26.

Between each projection 22*b* and the winding 26 thereon is provided an insulator 25 for insulating the winding 26 and the projection 22*b* from each other.

Silicone grease G1 as a viscous heat transfer member is provided between the insulator 25 and the projection 22*b*. The silicone grease G1 is fully filled into a gap between the insulator 25 and the projection 22*b*. The silicone grease G1 used in this embodiment is a semi-solid, oily substance in which an alumina powder superior in thermal conductivity is mixed.

The stator core 22, windings 26, and insulators 25 are unitized.

The case 5 is provided with plural (eight in this embodiment) lugs 5*a* and the case 6 is also provided with the same number of lugs 6*a*. The lugs 5*a* and 6*a* are formed so as to be opposed to each other in the direction of combination when the cases 5 and 6 are combined together. In this embodiment, the lugs 5*a* and 6*a* are made of resin and have a thin-walled rib shape.

One axial end side and an opposite axial end side of the cylindrical portion 22*a* are axially sandwiched between the lugs 5*a* and 6*a* and the stator 3 is held thereby. Lug pairs are realized by the lugs 5*a* and 6*a*, so that the stator 3 is in contact with the cases 5 and 6 at only the portions of the lugs 5*a* and 6*a*. As an example of resin which forms the lugs 5*a* and 6*a*, mention may be made of polypropylene for example. Since the stator 3 is thus fixed by only the lugs 5*a* and 6*a*, it is difficult to radiate heat to an outer periphery portion of the stator.

The cylindrical inner wall 20 is disposed on an inner periphery side of the stator 3 and on an outer periphery side of the rotor 4 so that it comes into contact with the projections 22*b* of the stator 3 from the inner periphery side of the stator 3. The cylindrical inner wall 20, which has a cylindrical shape, functions to isolate the fluid flowing through the flow path 21 and the stator 3 from each other and waterproof the stator. One end side of the cylindrical inner wall 20 is supported by the case 5, while an opposite end side thereof is screwed to the case 6.

Silicone grease G2 as a viscous heat transfer member is filled between the inner wall 20 and the stator 3. As the silicone grease G2 there may be used, for example, a semi-solid, oily substance with an alumina powder superior in thermal conductivity mixed therein, like the silicone grease G1 referred to previously.

Figure 3:
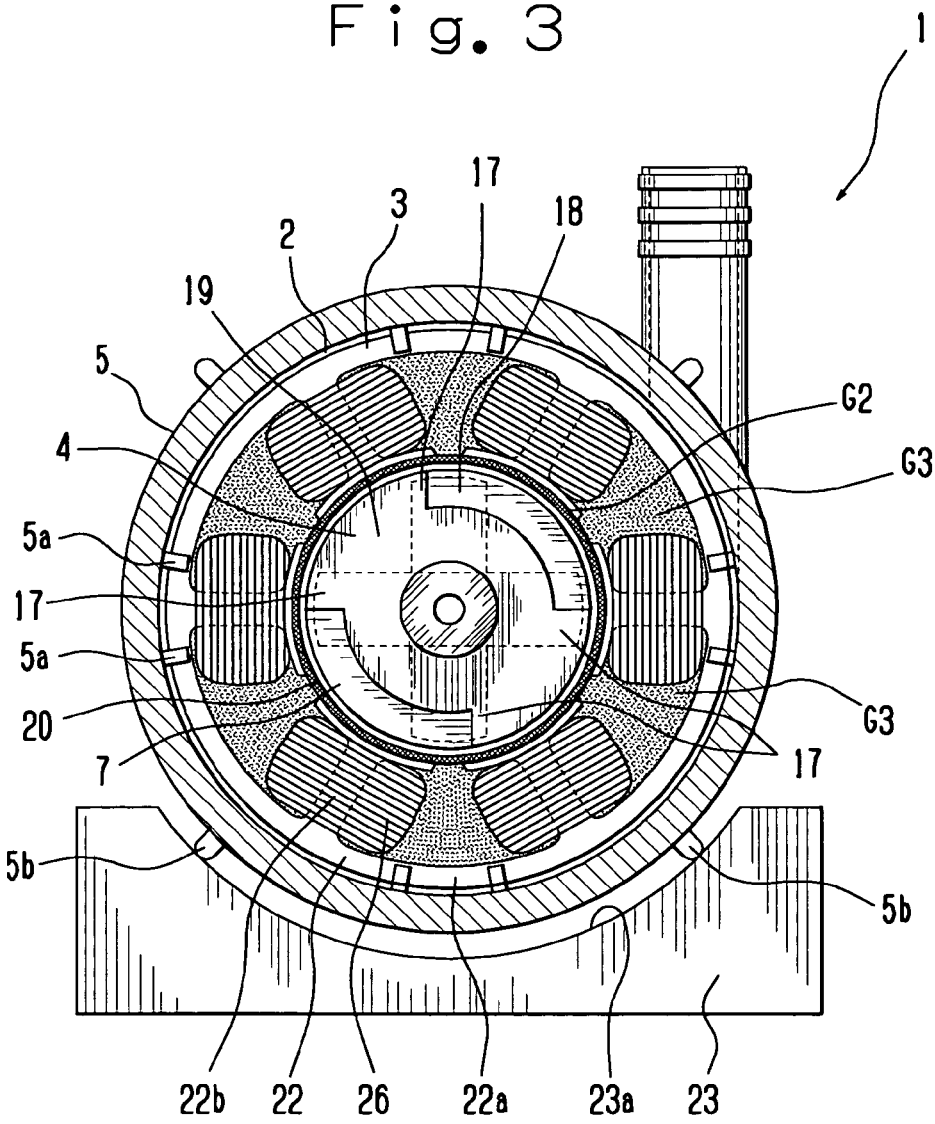
FIG. 3 is a front view in a vertical section, showing schematically the axial flow pump mounted on a mounting base of the pump.

As shown in FIG. 3, silicone grease G3 as a viscous heat transfer member is filled between the cylindrical inner wall 20 and the windings 26. More specifically, silicone grease G3 is filled in the space defined by each winding 26, cylindrical inner wall 20 and stator core 22. As a result, an outer surface of each winding 26 is coated with the silicone grease G3 and the spacing between the outer surface of the winding 26 and the cylindrical inner wall 20 is filled with the silicone grease G3, the cylindrical inner wall 20 and the winding 26 being contiguous to each other through the silicone grease G3.

The pump chamber 7 is formed by the inner wall 20 and the cases 5, 6. Fluid which has entered the pump chamber 7 flows through the suction port 8 to one end side of the flow path 21, then flows through an opposite end side of the flow path 21 into a pressure chamber 28, and flows out from the discharge port 9. The pressure chamber 28 fulfills a function for converting a rotational kinetic energy of the fluid into static pressure energy.

Plural lugs 5*b* are formed on the outside of the case 5 so as to project outward from the case 5. The lugs 5*b* are made of resin and have a thin-walled rib shape.

When the axial flow pump 1 of this embodiment is to be used, it is mounted on the mounting base 23 having a semi-circular mounting surface 23*a*. When the axial flow pump 1 is mounted on the mounting base 23, only the lugs 5*b* come into contact with the mounting base 23, whereby an air layer is formed between the mounting base 23 and the cases 5, 6.

In the axial flow pump of such a construction, magnetic poles 24 of the stator 3 are successively excited and changed over, whereby the rotor 4 is rotated. The rotation of the rotor 4 causes rotation of the axial flow blade 19 which is constituted by the spiral recess 18 on the outer periphery of the rotor 4. With this rotation of the axial flow blade 19, as indicated with arrows in FIG. 1, fluid flows into the pump through the suction port 8, then flows through the flow path 21 formed by both cylindrical inner wall 20 and spiral recess 18 of the rotor 4, further passes through the pressure chamber 28 and flows out from the discharge port 9.

While the axial flow pump 1 is in operation as described above, heat is generated from the windings 26 of the motor 2. The heat generated upon energization of the windings 26 is transmitted from the windings 26 to the stator core 22 and the cylindrical inner wall 20, then is transmitted via the cylindrical inner wall 20 to the fluid flowing through the flow path 21 in the pump chamber 7.

As noted earlier, the cylindrical inner wall 20 is in direct contact with the fluid flowing through the flow path 21 in the pump chamber 7 and is formed of metal. Therefore, as compared with the conventional pump wherein the portion in direct contact with fluid is formed of resin, it is possible to improve the thermal conductivity for the transfer of heat generated in the windings 26 of the motor 6 to fluid and hence possible to transmit the heat in a larger amount to the fluid than in the conventional pump. Consequently, it is possible to improve the utilization rate of the heat generated from the motor 2.

Particularly, the cylindrical inner wall 20 is formed using stainless steel as the inner wall, whose thermal conductivity (second conductivity) is about 16 W/(m·k) In the case of polypropylene as an example of the resin, its thermal conductivity (first conductivity) is about 0.2 W/(m·k). Thus, there arises a difference of two orders of magnitude between the case where the cylindrical inner wall 20 is formed using stainless steel and the case where it is formed of polypropylene. By forming the cylindrical inner wall 20 with use of metal (stainless steel) it is possible to improve the thermal conductivity to a remarkable extent.

Moreover, since the cases 5 and 6 including lugs 5*a* and 6*a* are made of resin, thermal conductivity (the first thermal conductivity) of which is lower than the inner wall's, the heat generated from the windings 26 is hard to be transmitted to the cases 5 and 6.

In other words, the heat generated from the stator windings 26 can be transmitted more easily to the fluid side.

Further, in the axial pump 1, silicone grease G2 as a viscous heat transfer member is filled between the stator 3 and the cylindrical inner wall 20, so even if an air layer is formed between the stator 3 and the cylindrical inner wall 20 due to surface roughness of the two, the air layer can be eliminated by the silicone grease G2.

As a result, the heat generated from the windings 26 is easier to be transmitted to the cylindrical inner wall 20 through the silicone grease G2.

In this embodiment, moreover, since lugs 5*b* projecting outwards of the cases 5 and 6 from the outer surfaces of both cases are formed so as to support the axial flow pump 1, it is possible to diminish the area of contact between the cases 5, 6 and the mounting base 23.

Further, since the cases 5 and 6 are brought into contact with the mounting base 23 through lugs 5*b*, an air layer is formed between the cases 5, 6 and the mounting base 23.

With such an air layer having thermal insulation properties, it is possible to suppress the transfer of heat generated from the windings 26 to the mounting base 23 side through the cases 5 and 6 and facilitate the transfer of the heat to the fluid flowing through the flow path 21.

But, in the cases 5 and 6 made of resin without lugs 5*a* and 6*a*, the heat generated from the windings 26 is hard to radiate to the exterior through the cases 5 and 6 because the thermal conductivity (the first thermal conductivity) of resin is lower than the inner wall's (the second thermal conductivity).

Although the heat resistance to the exterior is higher than that in the case having lugs 5*a* and 6*a*, the insulation of the heat on the whole is still effective.

Another embodiment of the present invention will now be described with reference to FIG. 4. This embodiment is an example of application of the present invention to a fluid circulating apparatus which is provided with the axial flow pump 1 of the above embodiment and in which a heated fluid, e.g., heated water, is circulated to heat an object to be heated such as a floor or a bathtub in the course of its circulation. The same portions as in the previous embodiment will be identified by the same reference numerals and explanations thereof will be omitted.

Figure 4:
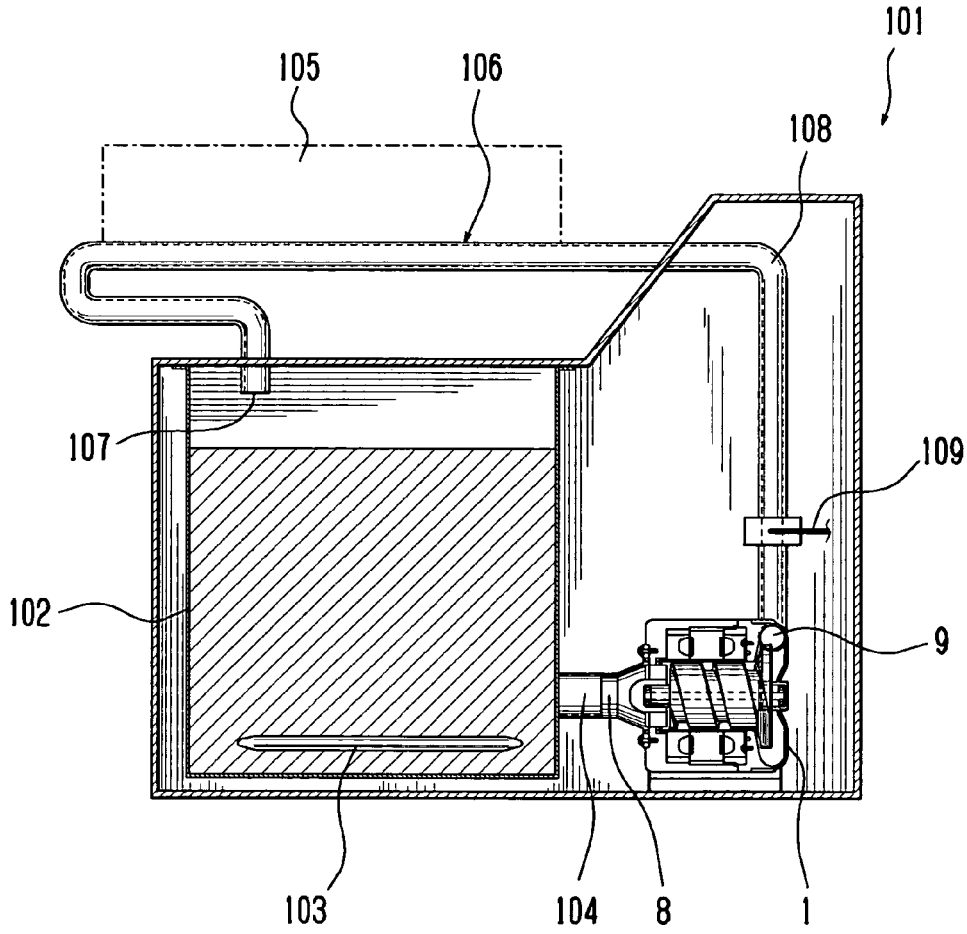
FIG. 4 is a side view in a vertical section, showing schematically a fluid circulating apparatus according to another embodiment of the present invention.

As shown in FIG. 4, the fluid circulating apparatus 101, is provided with a water tank 102 for the storage of fluid. In the water tank 102 is formed a discharge port 104 for discharging the fluid stored in the water tank 102 to the exterior of the tank.

Within the water tank 102 is disposed a heater 103 for heating the fluid stored in the water tank.

The axial flow pump 1 is connected to the discharge port 104 of the water tank 102 in such a manner that the suction port 8 and the discharge port 104 are put in communication with each other.

A pipe 108 is connected to the discharge port 9 of the axial flow pump 1. The pipe 108 forms a flow path extending from the discharge port 9 back to the water tank 102 through an object to be heated 105.

A temperature sensor 109 is attached to the pipe 108 at a position downstream of the heater 103 and the axial flow pump 1 in the fluid circulating direction and upstream of the object 105 in the same direction to detect the temperature of the fluid flowing through the pipe 108. The temperature sensor 109 is located in a portion of the pipe 108 located between the axial flow pump 1 and a heating position 106. As an example of the temperature sensor 109, mention may be made of a thermistor temperature sensor.

When the axial flow pump 1 is actuated in the fluid circulating apparatus 101, fluid circulates through the water tank 102, axial flow pump 1, pipe 108, and water tank 102 in this order. Here there is established a circulation path.

Next, a description will be given about a heating operation of the fluid circulating apparatus 101 for the object 105 to be heated. First, the fluid present within the water tank 102 is heated with the heater 103 and the thus-heated fluid is delivered to the pipe 108 by the axial flow pump 1. The fluid thus delivered to the pipe 108 passes the heating position 106 and again returns into the water tank 102. At this time, the fluid transmits heat to (is deprived of heat by) the object 105, whereby the object 105 is heated. The fluid, whose temperature is reduced by the degree corresponding to the amount of the heat lost, flows back into the water tank 102 and is heated again with the heater 103.

The fluid circulating apparatus 101 is provided with a controller (not shown) for controlling the temperature of the fluid. In the fluid circulating apparatus 101, the fluid temperature is controlled by the controller so as to apply a constant amount of heat to the object 105 to be heated. The heater 103 is controlled by the controller so that the temperature detected by the temperature sensor 109 is constant.

In the fluid circulating apparatus 101 constructed as above, not only the heat provided by the heater 103 but also the heat generated from the windings 26 in the axial flow pump 1 is transmitted to the object 105 through the fluid.

As a result, in the fluid circulating apparatus 101, the fluid heating by the heater 103 may be omitted by an amount of heat corresponding to the amount of heat generated from the windings 26 of the axial flow pump 1. Thus, the heat generated from the windings 26 can be utilized effectively and thus, in comparison with the case where the fluid is heated with the heater 103 alone, it is possible to diminish the energy required for heating the fluid and lighten the load on the heater 103. That is, in the fluid circulating apparatus 101, the electric energy fed to the heater 103 can be decreased in comparison with the case where the axial flow pump 1 is not used.

Thus, in the fluid circulating apparatus 101 which heats the object 105 (e.g., floor or bathtub) by the circulation of fluid heated with the heater, the axial flow pump 1 is provided in which the heat generated from the windings 26 is easier to be transmitted to the fluid as compared with the conventional pump, whereby the electric energy fed to the heater 103 in the fluid circulating apparatus 101 can be made smaller than in the use of the conventional pump. That is, the fluid circulating apparatus 101 of this embodiment permits the saving of energy in comparison with the conventional fluid circulating apparatus.

Moreover, the temperature sensor 109 (e.g., a thermistor temperature sensor) is disposed downstream of the heater 103 and the axial flow pump 1 in the fluid circulating direction and upstream of the object 105 (e.g., floor) in the same direction, so that the temperature sensor 109 can detect accurately the temperature of the fluid which is heated by the heater 103 and the axial flow pump 1 and which is before heating the object 105.

Consequently, the amount of heat to be applied to the object 105 can be controlled accurately.

In the conventional fluid circulating apparatus wherein the temperature sensor is disposed within the water tank, fluid is heated by the axial flow pump 1 after leaving the water tank 102. Therefore, for example in the case where the temperature sensor 109 is disposed within the water tank 102, it is difficult to accurately detect the temperature of fluid before heating the object 105 to be heated.

Obviously, numerous modifications and variations of the present invention are possible in light of the above teachings. It is therefore to be understood that within the scope of the appended claims, the invention may be practiced otherwise than as specifically described herein.

What is claimed is:

1. An axial flow pump comprising:

a case having an outer wall, a fluid suction port and a discharge port, the outer wall having a first thermal conductivity;

a stator having a winding and disposed in the case;

a cylindrical inner wall disposed inside the stator and in contact with the stator, the inner wall having a second thermal conductivity higher than the first thermal conductivity of the outer wall;

a rotor disposed inside the inner wall and rotated upon energization of the winding of the stator, the energization of the winding causing generation of heat from the winding; and a flow path formed between the rotor and the inner wall, the flow path being communicated in fluid with the fluid suction port and the fluid discharge port, wherein the heat from the winding is transferred to the fluid in the flow path through the inner wall due to difference of the thermal conductivity between the outer wall and the inner wall.

2. A pump according to claim 1, wherein the cylindrical inner wall includes a non-magnetic cylindrical metal plate and the outer wall includes a resin.

3. A pump according to claim 1, wherein the outer wall has an inner surface and further includes a plurality of projections extending from the inner surface toward the stator to support the stator.

4. A fluid circulating apparatus comprising:

a fluid circulation path;

a heater for heating fluid circulating through the fluid circulation path; and an axial flow pump comprising:

a case having an outer wall, a fluid suction port and a discharge port, the outer wall having a first thermal conductivity;

a stator having a winding and disposed in the case;

a cylindrical inner wall disposed inside the stator and in contact with the stator, the inner wall having a second thermal conductivity higher than the first thermal conductivity of the outer wall;

a rotor disposed inside the inner wall and rotated upon energization of the winding of the stator, the energization of the winding causing generation of heat from the winding; and a flow path formed between the rotor and the inner wall, the flow path being communicated in fluid with the fluid suction port and the fluid discharge port, wherein, with the rotation of the rotor, the fluid is circulated in the fluid circulation path.

5. A fluid circulating apparatus according to claim 4, further comprising:

an object to be heated which is disposed in the fluid path; and a temperature sensor for detecting the temperature of the fluid, the temperature sensor being disposed between the axial flow pump and the object.

* * * * *